US005689963A

United States Patent [19]

Bahel et al.

[11] Patent Number: 5,689,963

[45] Date of Patent: Nov. 25, 1997

[54] DIAGNOSTICS FOR A HEATING AND COOLING SYSTEM

[75] Inventors: Vijay Bahel, Sidney; Hank Millet, Piqua; Mickey Hickey, Sidney; Hung Pham, Dayton; Gregory P. Herroon, Piqua; Gerald L. Greschl, Dayton, all of Ohio

[73] Assignee: Copeland Corporation, Sidney, Ohio

[21] Appl. No.: 712,904

[22] Filed: Sep. 12, 1996

Related U.S. Application Data

[62] Division of Ser. No. 433,619, May 3, 1995, Pat. No. 5,623,834.

[51] Int. Cl.[6] ..... F25B 49/02

[52] U.S. Cl. ..... 62/129; 62/204; 62/228.3

[58] Field of Search ..... 62/129, 126, 127, 62/228.3, 180, 179, 160, 208, 209, 203, 204

[56] References Cited

U.S. PATENT DOCUMENTS

| | | | |
|---|---|---|---|
| 2,978,879 | 6/1961 | Heidorn | 62/209 |
| 3,047,696 | 12/1962 | Heidorn | 200/140 |
| 3,107,843 | 10/1963 | Finn . | |
| 3,278,111 | 10/1966 | Parker . | |
| 3,729,949 | 5/1973 | Talbot | 62/149 |
| 4,034,570 | 7/1977 | Anderson et al. | 62/158 |
| 4,220,010 | 9/1980 | Mueller et al. | 62/126 |
| 4,236,379 | 12/1980 | Mueller | 62/126 |
| 4,286,438 | 9/1981 | Clarke | 62/216 |
| 4,301,660 | 11/1981 | Mueller et al. | 62/126 |
| 4,328,678 | 5/1982 | Kono et al. | 62/126 |
| 4,510,576 | 4/1985 | MacArthur et al. | 364/551 |
| 4,611,470 | 9/1986 | Enström | 62/127 |
| 4,612,775 | 9/1986 | Branz et al. | 62/126 |
| 4,677,830 | 7/1987 | Sumikawa et al. | 62/126 |
| 4,745,765 | 5/1988 | Pettitt | 62/129 |
| 5,157,934 | 10/1992 | Uchida | 62/212 |
| 5,186,014 | 2/1993 | Runk | 62/160 X |
| 5,239,865 | 8/1993 | Salzer et al. | 62/129 X |
| 5,241,833 | 9/1993 | Ohkoshi | 62/126 |
| 5,303,561 | 4/1994 | Bahel et al. | 62/186 |
| 5,303,562 | 4/1994 | Bahel et al. | 62/222 |
| 5,311,748 | 5/1994 | Bahel et al. | 62/160 |
| 5,319,943 | 6/1994 | Bahel et al. | 62/156 |
| 5,457,965 | 10/1995 | Blair et al. | 62/228.3 X |
| 5,586,445 | 12/1996 | Bessler | 62/129 X |

*Primary Examiner*—Harry B. Tanner
*Attorney, Agent, or Firm*—Harness, Dickey & Pierce

[57] ABSTRACT

Compressor discharge temperature, ambient outdoor air temperature and thermal load are used as control parameters for controlling the expansion valve setting and indoor fan speed. Diagnostics monitor a feedback signal from the fan motor to detect fan over-speed and increased speed due to decreased air flow caused by a dirty indoor air filter. Discharge pressure of the compressor is monitored to detect a blocked outdoor fan. The difference between actual and optimum compressor discharge temperatures and suction pressure of the compressor are monitored to detect a stuck-closed expansion valve or low refrigerant charge. Compressor "short-cycling" is limited to prevent reduced reliability of the compressor. The difference between compressor discharge temperature and outdoor coil temperature is measured before and after startup to detect compressor failure.

10 Claims, 13 Drawing Sheets

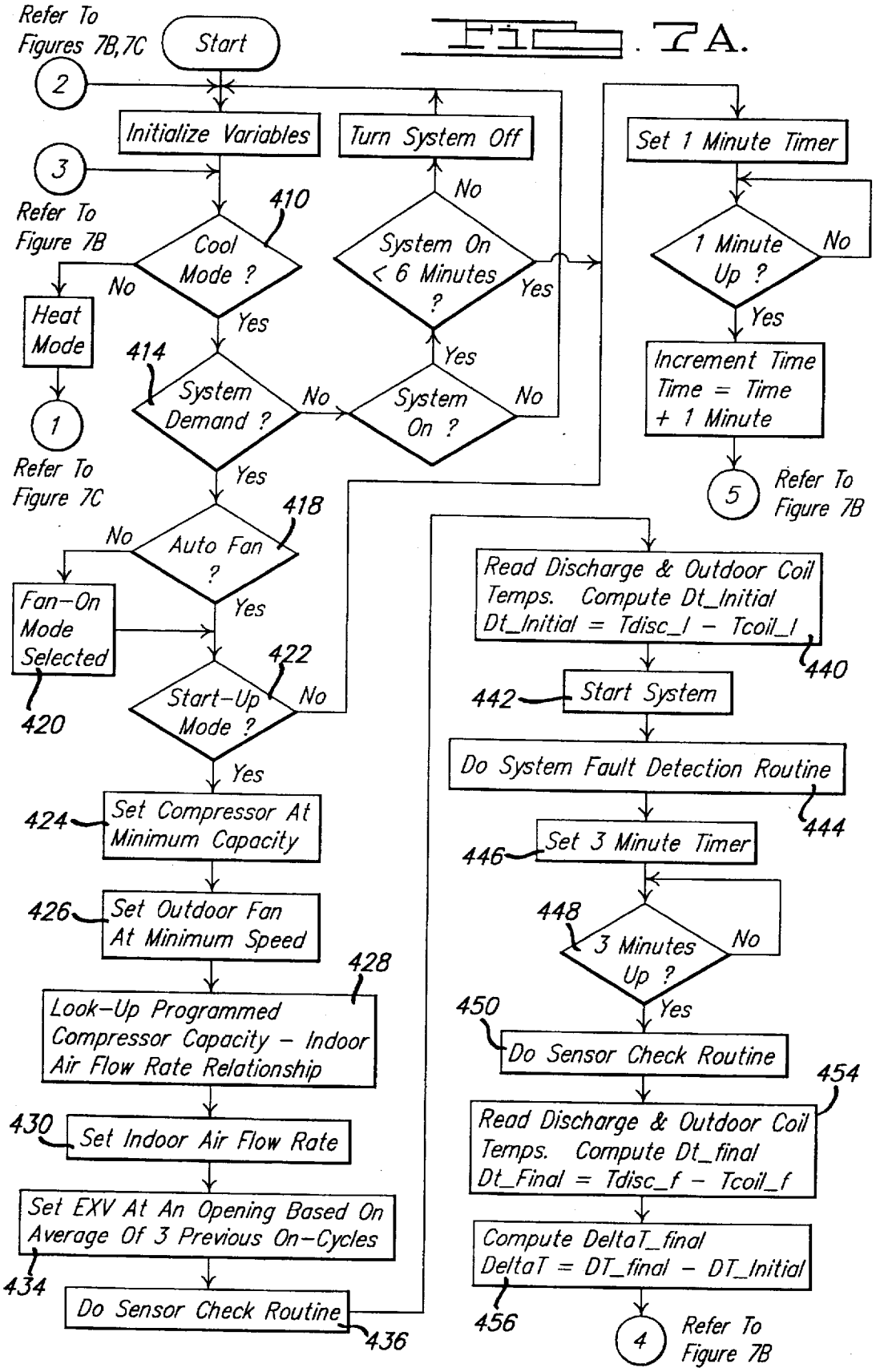
FIG. 7A.
Refer To Figures 7B,7C
Start
2
Initialize Variables
Turn System Off
Set 1 Minute Timer
3
Refer To Figure 7B
410
Cool Mode ?
No
Yes
Heat Mode
1
Refer To Figure 7C
414
System Demand ?
No
Yes
System On ?
No
Yes
System On < 6 Minutes ?
No
Yes
1 Minute Up ?
No
Yes
Increment Time Time = Time + 1 Minute
5
Refer To Figure 7B
418
Auto Fan ?
No
Yes
Fan-On Mode Selected
420
422
Start-Up Mode ?
No
Yes
424
Set Compressor At Minimum Capacity
426
Set Outdoor Fan At Minimum Speed
428
Look-Up Programmed Compressor Capacity - Indoor Air Flow Rate Relationship
430
Set Indoor Air Flow Rate
Set EXV At An Opening Based On Average Of 3 Previous On-Cycles
434
Do Sensor Check Routine
436
Read Discharge & Outdoor Coil Temps. Compute Dt_Initial
Dt_Initial = Tdisc_I - Tcoil_I
440
442
Start System
Do System Fault Detection Routine
444
446
Set 3 Minute Timer
448
3 Minutes Up ?
No
Yes
450
Do Sensor Check Routine
454
Read Discharge & Outdoor Coil Temps. Compute Dt_final
Dt_Final = Tdisc_f - Tcoil_f
Compute DeltaT_final
DeltaT = DT_final - DT_Initial
456
4
Refer To Figure 7B

400

| | |
|---|---|
| Operating Mode Flag | Difference Between Initial Discharge And Coil Temperature |
| Minimun Compressor Capacity | Warmup Timer |
| Minimum Outdoor Fan Speed | Final Compressor Discharge Temperature |
| Compressor Capacity/ Indoor Air Flow LUT | Final Outdoor Coil Temperature |
| EXV Setting Prior Three Cycles | Difference Between Final Discharge And Coil Temperatures |
| Average EXV Setting | Difference Between Final Differences And Initial Differences |
| Initial Compressor Discharge Temperature | Cooling Differential Limit |
| Initial Outdoor Coil Temperature | Heating Differential Limit |

FIG. 7E.

DIAGNOSTICS FOR A HEATING AND COOLING SYSTEM

This is a division of U.S. patent application Ser. No. 08/433,619, filed May 3, 1996, entitled DIAGNOSTICS FOR A HEATING AND COOLING SYSTEM U.S. Pat. No. 5,623,834.

BACKGROUND OF THE INVENTION

1. Technical Field

This present invention relates to heat pumps, air conditioning and refrigeration equipment. More particularly, the invention relates to diagnostics for identifying indoor fan failure, a dirty indoor filter, a blocked outdoor fan, low refrigerant charge, a stuck expansion valve, and compressor failure.

2. Discussion

The Applicants' assignee has developed a control system for heat pumps that has a decoupled sensor arrangement in which refrigerant is metered through the refrigeration system, based on compressor discharge temperature and ambient air temperature measurements. The sensors are decoupled in that the ambient air temperature and compressor discharge temperature are largely independent of one another. For further information, see U.S. Pat. No. 5,311,748 to Bahel et al., entitled "Control System for Heat Pump Having Decoupled Sensor Arrangement," issued May 17, 1994.

The Applicants' assignee has also developed a control system in which the indoor air flow rate is controlled by a humidity-responsive adjustable speed fan. The control system strives to select the fan speed for optimal operating efficiency and improved occupant comfort. For further details see U.S. Pat. No. 5,303,564 to Bahel et al. entitled "Control System for Heat Pump Having Humidity Responsive Variable Speed Fan," issued April 19, 1994.

The Applicants' assignee has also developed a refrigerant charge detection system or diagnostic system that detects improper amounts of refrigerant (overcharge and undercharge). For further details see U.S. Ser. No. 08/095,897 to Bahel et al. entitled "Overcharge-Undercharge Diagnostic System for Air-Conditioner Controller," filed Jul. 21, 1993.

The Applicants'assignee has also developed a variable capacity compressor system in which compressor discharge temperature, ambient outdoor air temperature and thermal load are used as control parameters for controlling the expansion valve setting and the indoor fan speed. The thermal load parameter can also be used to control the compressor capacity. Thermal load is measured by an integrating procedure that increments or decrements an accumulated demand counter value used as an indication of thermal load on the system. The counter value is incremented and decremented based on the room temperature and thermostat set point. These same parameters are also used in the overcharge/undercharge diagnostic system. For further details see U.S. Ser. No. 08/415,640 to Bahel et al. entitled "Heating and Cooling System With Variable Capacity Compressor", filed Apr. 3, 1995.

Industry demand for improved operation requires more sophisticated diagnostics for identifying faulty system operation to prevent damage to the heat pump system or components thereof and to provide optimum operation and efficiency. Conventional heat pump diagnostic systems operate in a "short-cycling" mode, when certain fault conditions occur, until the user becomes aware of the malfunction. Prolonged short-cycling can adversely affect compressor reliability. Other conventional heat pump diagnostic systems fail to correctly identify fault conditions such as indoor fan failure, a dirty indoor fan filter, a blocked outdoor fan, a stuck-closed expansion valve or low refrigerant charge.

SUMMARY OF THE INVENTION

The present invention strives to integrate the advantages of Applicant's assignees prior systems with the advantages of diagnostics for detecting system malfunctions. According to one aspect of Applicant's invention, diagnostic procedures monitor a feedback signal from the fan motor to detect fan over-speed and increase speed due to decreased air flow caused by a dirty indoor air filter. Thus, the present invention can identify a dirty indoor air filter allowing replacement and improved efficiency.

According to another aspect of the invention, discharge pressure of the compressor is monitored to detect a block outdoor fan, a common cause of increased compressor pressure.

In yet another aspect of the invention, the difference between actual and optimum compressor discharged temperatures and low suction pressure of the compressor are monitored to detect a stuck-closed expansion valve and/or low refrigerant charge malfunctions. The detection procedure limits "short-cycling" of the compressor to prevent reduced reliability of the compressor due to excessive short-cycling.

In still another aspect of the invention, the difference between compressor discharged temperature and outdoor coil temperature are measured before and after startup to detect compressor failure.

Through the enhancements and features described herein, the Applicants' invention achieves a high degree of control over the refrigeration cycle, as well as greatly improving reliability and operation through the prompt detection of malfunctions. For a more complete understanding of the objects and advantages of the invention, reference may be had to the following specification and to the accompanying drawings.

BRIEF DESCRIPTION OF THE DRAWINGS

The various advantages of the present invention will become apparent to those skilled in the art after studying the following specification and by reference to the drawings in which:

FIG. 6 is flow chart showing default component setting procedure employed in the procedure of FIGS. 5A and 5B and its associated data structures;

FIGS. 7A, 7B, 7C, 7D and 7E are flowcharts showing system control and including the compressor failure detection procedure and its associated data structures;

DESCRIPTION OF THE PREFERRED EMBODIMENT

1. Hardware System Description

Figure 1:
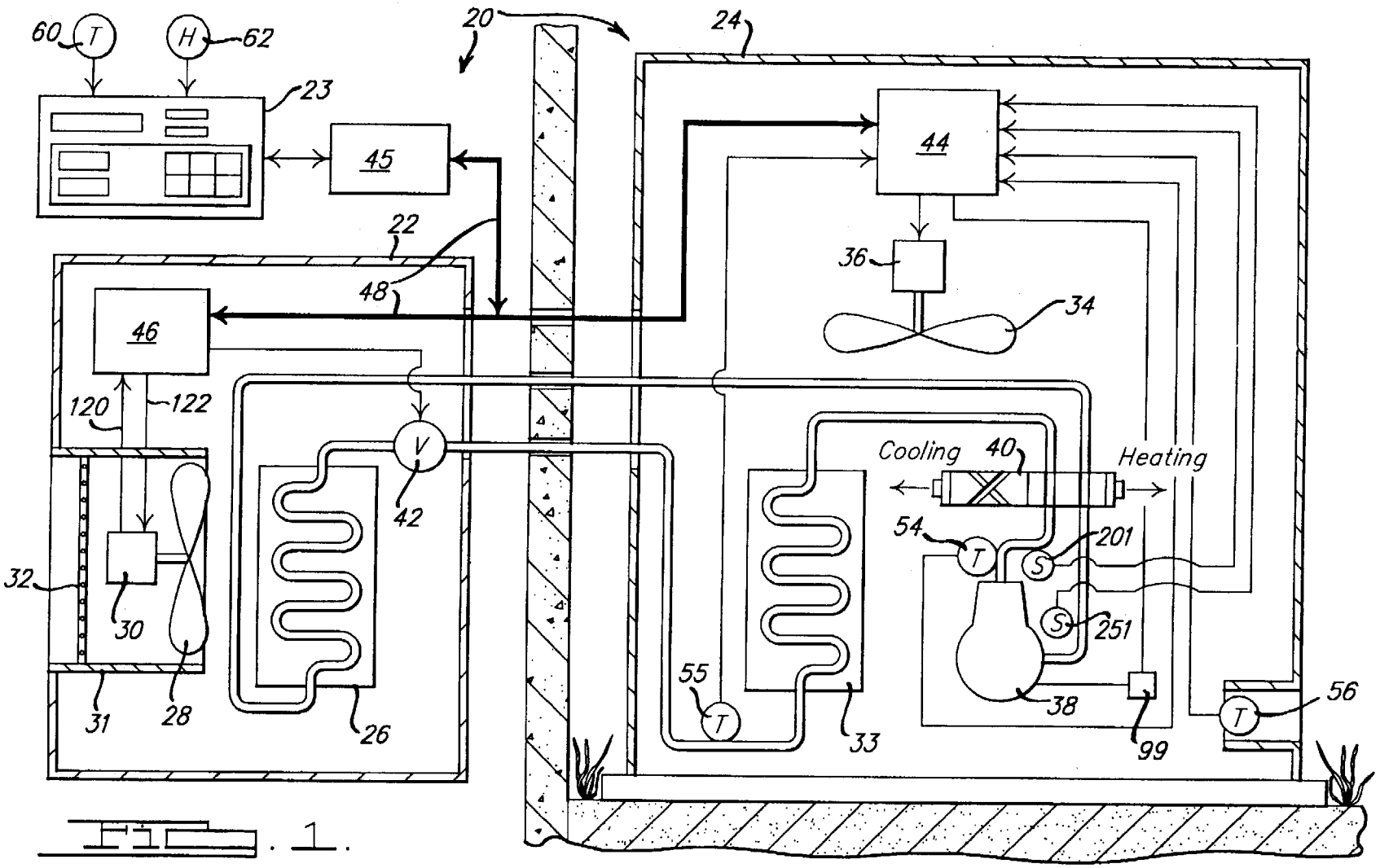
FIG. 1 is a schematic representation of a system illustrating a heat pump having selectable HEATING and COOLING modes.

The presently preferred heat pump system is illustrated schematically in FIG. 1. In FIG. 1 the heat pump system is depicted generally at 20. Unless otherwise stated, the term heat pump, as used herein, refers generally to any pumped refrigerant heating and cooling system, including air conditioning systems. The illustrated embodiment in FIG. 1 is able to pump heat into the building (HEATING mode) and out from the building (COOLING mode). Although both modes are illustrated, the principles of the invention also applies to systems which operate in only one mode.

Heat pump system 20 includes an indoor unit 22 and an outdoor unit 24. The indoor unit includes an indoor coil or heat exchanger 26 and an indoor fan or blower 28. The indoor fan is preferably driven by a variable speed motor 30, such as a brushless permanent magnet motor. The indoor fan and coil are enclosed in a suitable cabinet 31 so that the fan forces ambient indoor air through an indoor air filter 32 and across the indoor coil at a rate determined by the speed of the variable speed motor.

The outdoor unit includes an outdoor coil for heat exchanger 33 and an outdoor fan 34 driven by suitable motor 36. Preferably the outdoor unit includes a protective housing which encases the outdoor coil and the outdoor fan, so that the outdoor fan draws ambient outdoor air across the outdoor coil to improve heat transfer.

The outdoor unit also houses compressor 38. Compressor 38 may be a variable capacity compressor. The compressor may be a two-speed compressor, capable of operating at two capacities (e.g., 50% capacity and 100% capacity). Alternatively, multiple compressors may be used in tandem to achieve variable capacity. For example, a two ton compressor and a three ton compressor may be used in tandem to achieve three discrete capacities, namely two ton, three ton and five ton. Alternatively, a continuously variable speed compressor may be used. The continuously variable speed compressor may be operated at different speeds by changing the AC current frequency (e.g., 40 Hertz to 90 Hertz to 120 Hertz).

As noted above, the illustrated embodiment can be used for both heating and cooling. This is accomplished by the four-way reversing valve 40, which can be selectively set to the COOLING position or the HEATING position to control the direction of refrigerant flow. In FIG. 1 the COOLING position has been illustrated. In the COOLING position, the indoor coil functions as the evaporator coil and the outdoor coil functions as the condenser coil. When valve 40 is switched to the HEATING position (the alternative position), the functions of coils 26 and 33 are reversed. In the HEATING position the indoor coil functions as the condenser and the outdoor coil functions as the evaporator.

The heat pump system further includes an electronically controllable expansion valve 42. In the presently preferred embodiment, the expansion valve is a continuously variable (or incrementally variable) stepper motor valve which can be adjusted electronically to a wide range of orifice sizes or valve openings, ranging from fully opened to fully closed. Although it is possible to implement the control system of the invention with other types of valves, pulse width modulated valves being an example, the present embodiment prefers the stepper motor valve because it provides ripple-free operation. The stepper motor valve only needs to move or cycle when an orifice size adjustment is made. The valve modulation may occur several times during a typical operating sequence (e.g., several times per hour). In contrast, the pulse width modulated valve cycles continuously during the entire operating sequence.

The preferred embodiment is constructed as a microprocessor-based distributed architecture, employing multiple control units. These control units include an outdoor control unit 44, a room control unit 45 and an indoor control unit 46. The control units are connected via serial communication link 48. Room control unit 45 is coupled to thermostat 23, and may optionally be integrated into the thermostat housing.

The presently preferred system employs a plurality of sensors which will now be described in connection with FIG. 1. The outdoor unit 24 includes compressor discharge temperature sensor 54, outdoor coil sensor 55 and outdoor ambient air temperature sensor 56. As illustrated, sensor 56 is positioned so that it is shielded from direct sun, but so that it is in the air flow path generated by fan 34. Sensors 54, 55 and 56 are coupled to the outdoor control unit 44. Thermostat 23 includes an indoor temperature sensor 60 and an indoor humidity sensor 62. Readings from sensors 60 and 62 are supplied to room control unit 45.

According to the distributed architecture, the microprocessor-based control system assigns different tasks to each of the control units. Outdoor control unit 44 is responsible for collecting sensor readings from sensors 54–56 and for communicating those readings to indoor control unit 46. Outdoor control unit 44 supplies control signals for operating the outdoor fan 34 and also for controlling the contactor 99, which in turn supplies AC power to the compressor.

Room control unit 45 collects indoor temperature and humidity data from thermostat 23 and supplies this data to the indoor control unit 46. Room control unit 45 also supplies data to the thermostat for displaying temperature readings and messages on the thermostat display. The thermostat may include a liquid crystal display, or the like, for this purpose. Indoor unit 46 receives the sensor readings from control units 44 and 45, and provides control signals to the indoor fan 28 and to the expansion valve 42.

The present invention preferably employs a demand counter for determining the demand or load on the heat pump system. The demand counter procedure can be executed by the microprocessor of the room control unit 45 or alternately by the microprocessor of the indoor control unit 46. The demand counter procedure is described in detail in U.S. Ser. No. 08/415,640 to Bahel et al. entitled "Heating and Cooling System With Variable Capacity Compressor", filed Apr. 3, 1995. The demand counter and outdoor air temperature are used to access a lookup table stored in memory of the microprocessor of the room control unit 45 or the indoor control unit 46. The lookup table stores an optimum discharge temperature.

The values stored in the lookup table can be empirically determined by operating the system under controlled conditions during design. Essentially the designer selects the optimum discharge temperature that will achieve optimal efficiency in performance for the particular outdoor temperature and demand counter setting involved. In this regard, the demand counter settings reflect the load on the system, which is in turn a function of the thermostat setting and the indoor air temperature. These can be readily controlled during calibration of the lookup table. Although a lookup table is presently preferred, computational procedures can be used instead. For example a first order "linear" equation can be empirically determined to yield the target discharge temperature for the demand counter and the outdoor temperature setting involved.

2. Indoor Fan Motor Failure/Dirty Indoor Air Filter Diagnostic

In the heat pump system according to the invention, the diagnostic system monitors a feedback signal 120 from the indoor fan motor 30 to (a) to determine if the indoor fan motor 30 is operating and, (b) determine if the indoor air filter 32 is dirty. The indoor fan motor speed is preferably communicated to indoor control unit 46 and/or to room control unit 45.

The heat pump system is preferably operated with a fan motor which provides a constant air flow rate proportional to an input signal on fan input 122. As particulates are filtered by fan filter 32, the fan filter becomes "dirty" and drawing air through the filter becomes more difficult. In other words, as the fan filter becomes dirty, the fan motor speed increases to maintain the constant air flow rate. The increase in fan speed is related to the increase in particulates collecting on the fan filter. The heat pump system according to the invention monitors the fan speed to identify a dirty indoor fan filter.

The present preferred embodiment employs an indoor fan motor failure/dirty indoor fan filter detection procedure 148 (hereinafter fan/filter detection procedure) for identifying indoor fan motor 30 failure or a dirty indoor air filter. Fan/filter detection procedure 148 can be executed by the microprocessor of the indoor control unit 46, by the room control unit 45, or by a combination of both units.

Figure 2:
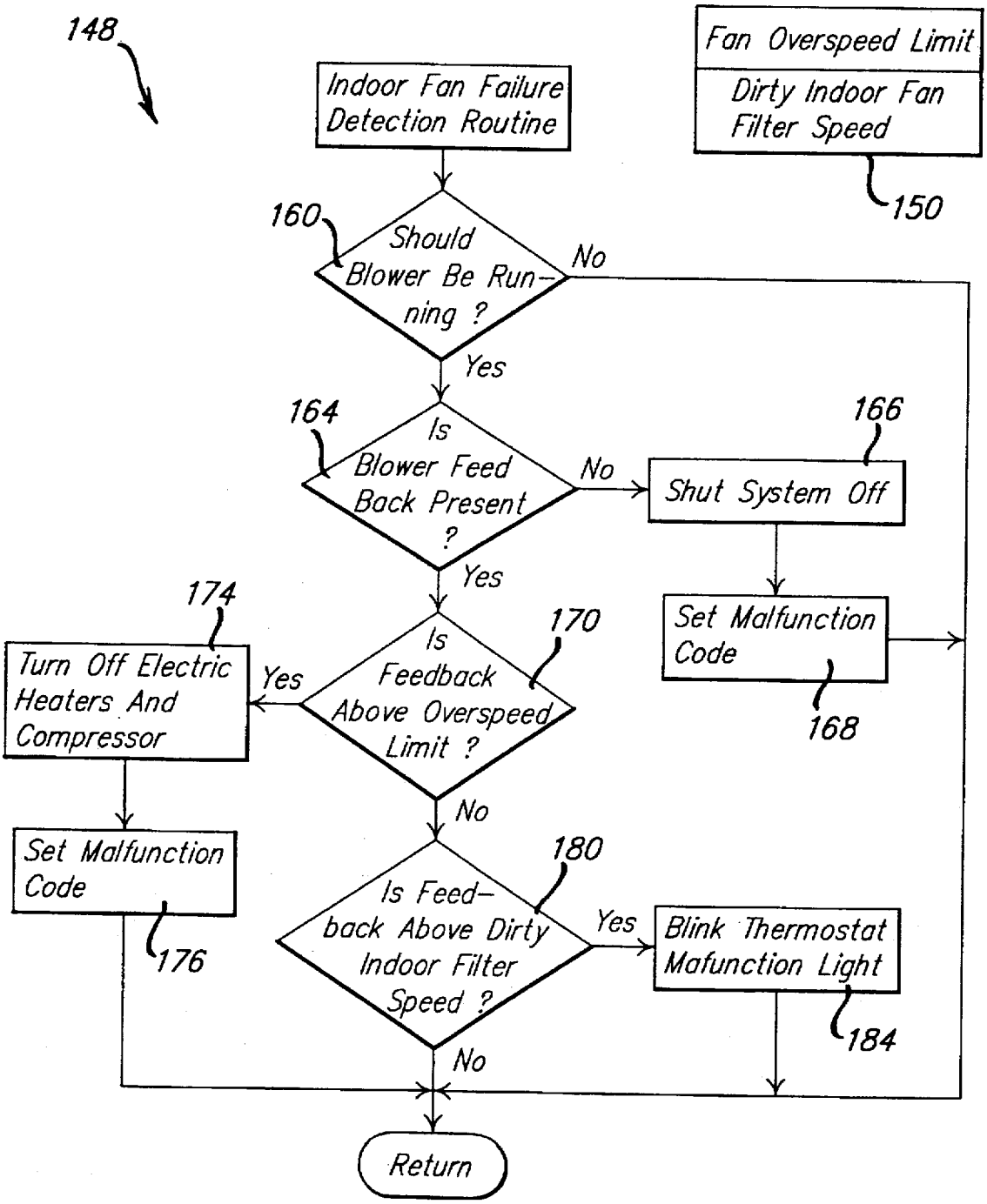
FIG. 2 is a flow chart showing an indoor fan failure/dirty filter diagnostic procedure.

FIG. 2 illustrates fan/filter detection procedure 148. In FIG. 2, the data structure for fan/filter detection procedure 148 is depicted diagrammatically at 150. Data structure 150 includes a fan over-speed limit (used to identify fan over-speed), and a dirty indoor fan filter speed limit (used to identify a dirty indoor fan filter for a current operating condition) (further described below in conjunction with FIG. 3).

Fan/filter detection procedure is performed as illustrated in FIG. 2. Beginning at 160, the system checks to see if the indoor fan should be on. If not, fan/filter detection procedure 148 is ended. If the indoor fan should be running, control proceeds to step 164 where the system checks to see if fan feedback signal 120 is present. If fan feedback signal 120 is not present, control shuts the heat pump system off at 166 and sets a fan motor malfunction code at 168.

If fan feedback signal 120 is present, control determines if the fan feedback signal is above a fan over-speed limit at 170. If the fan feedback signal 120 is above the fan over-speed limit, control turns off the electric heaters and compressor at 174 and sets a fan over-speed malfunction code at 176.

If fan feedback is not above the fan over-speed limit, control branches to step 180 where the feedback is compared to a dirty indoor fan filter speed limit. If fan feedback signal 120 does not exceed the dirty indoor fan filter speed limit, the fan/filter detection procedure 148 is complete. If feedback exceeds the dirty indoor filter speed for the current operating condition, a dirty fan filter malfunction is indicated, for example by blinking a thermostat malfunction light at step 184.

Figure 3:
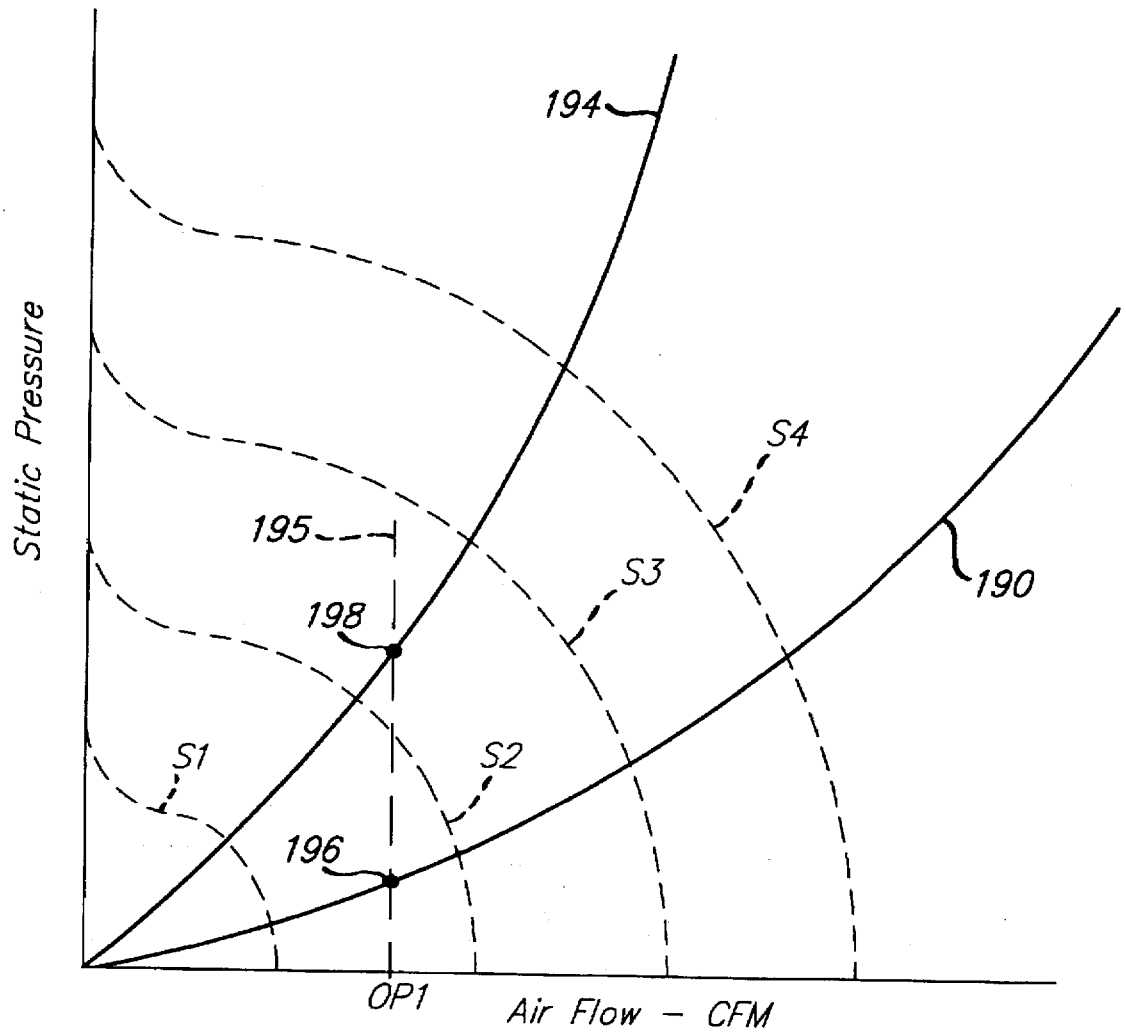
FIG. 3 is a graph illustrating the relationship between system resistance, pressure and air flow which is employed in the diagnostic procedure of FIG. 2.

FIG. 3 illustrates system pressure as a function of air flow. Dotted curves S1, S2, S3 and S4 illustrate increasing fan motor speed, respectively. Curve 190 illustrates system resistance when a clean filter is employed while curve 194 illustrates system resistance when a dirty filter is employed. As can be appreciated, system resistance is lower for a clean filter. A microprocessor in either room control unit 45 or indoor control unit 46 employs the relationship illustrated in FIG. 3 to identify a dirty indoor fan filter. As can be appreciated from FIG. 3, as particulates are removed from the filtered air by the indoor fan filter and build up on the indoor fan filter, the air flow to the fan is decreased and the fan motor speed increases due to increased drag of the reduced air flow.

At operating condition 1 (indicated by "OP1" and dotted lines 195 in FIG. 3), the fan speed is indicated at 196 for a clean indoor fan filter. As particulates removed from the filtered air build up, system resistance increases and fan motor speed increases. When system resistance increases sufficiently, the fan motor speed (as reflected by the fan feedback signal) exceeds the dirty fan speed limit at 198 for OP1.

Thus, the actual speed as indicated by fan feedback 120 can be compared to determine whether the indoor fan filter is dirty. As can be appreciated, optimum identification of a dirty fan filter allows the filter to be promptly replaced to increase system performance and efficiency.

3. Blocked Outdoor Fan Detection Procedure

The present invention monitors the pressure of the discharge side of the compressor during the COOLING mode. A high discharge pressure is generally caused by a blocked outdoor fan.

Figure 4:
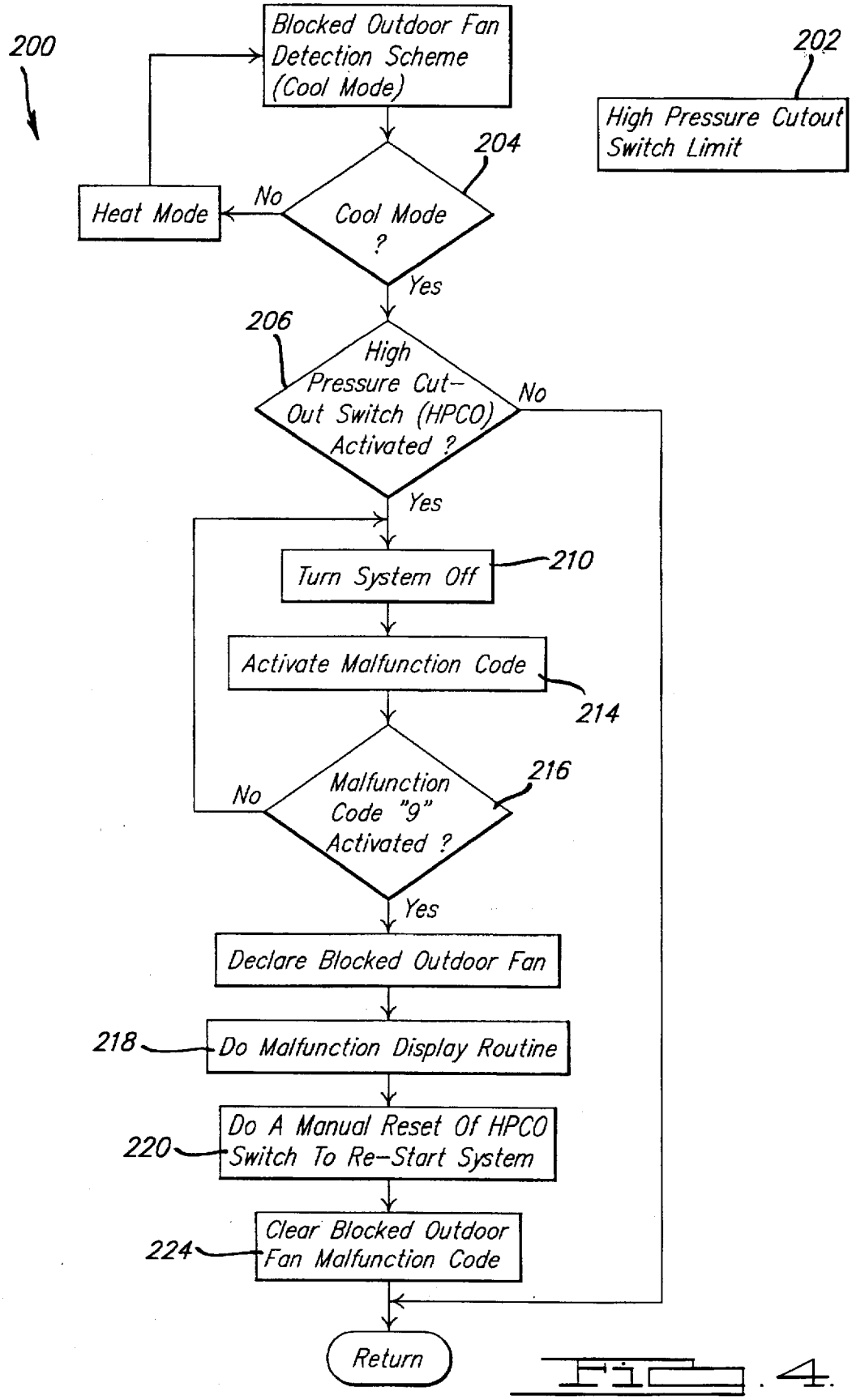
FIG. 4 is a flow chart showing a blocked outdoor fan detection procedure and its associated data structure.

FIG. 4 illustrates a blocked outdoor fan detection procedure 200. FIG. 1 illustrates a high pressure cutout (HPCO) device 201 at the discharge of the compressor 38. The HPCO device 201 can be a manually set switch which breaks an electrical connection to the compressor in the event the pressure exceeds a pressure set point or HPCO limit (for example, 400 psi). Alternatively, the HPCO device 201 can be a pressure sensor providing a pressure signal related to the discharge pressure. If a pressure sensor is employed, the data structure for the blocked outdoor fan detection procedure is depicted diagrammatically at 202. The data structure includes a HPCO limit (used to store the discharge pressure above which system operation should be terminated).

The blocked outdoor fan detection procedure 200 operates as indicated in FIG. 4. The blocked outdoor fan detection procedure 200 determines whether the heat pump system is in the COOLING mode at 204. If the system is in the COOLING mode, control branches to step 206 where the system determines whether the discharge pressure from the compressor 38 exceeds the HPCO limit (manually set or stored in data structure 202 if device 201 is a pressure sensor). If the discharge pressure exceeds the HPCO limit, the system is turned off at step 210, a malfunction code is set at step 214 and the system checks to see if the blocked outdoor fan malfunction code has been activated at 216.

To restart the system, an operator displays malfunction codes at step 218 and manually resets the HPCO device 201 to restart the system at 220. Once the system is restarted, the blocked outdoor fan malfunction code is reset at step 224.

As a result of employing the blocked outdoor fan detection procedure, extremely high discharge pressures, which can damage the system, can be detected. Additionally, the typical cause of the high discharge pressures can be readily identified through the blocked outdoor fan malfunction code.

4. Stuck-Closed Expansion Valve/Lost Refrigerant Charge Detection Procedure

During operation, low pressure at the inlet of the compressor 38 can be caused by a stuck-closed expansion valve or by low refrigerant charge. A stuck-closed expansion valve restricts refrigerant flow which reduces suction pressure. If the system continues to operate with low inlet pressure, compressor damage can easily occur.

The present invention monitors the inlet pressure of the compressor to identify low inlet pressure to avoid costly compressor damage. To that end, a low pressure cutout (LPCO) device 251, located on the inlet side of the compressor, measures inlet pressure. The LPCO device is preferably a conventional pressure switch. Alternately, a pressure sensor coupled to a microprocessor or a trigger switch can be employed. Still other LPCO devices will be apparent to skilled artisans.

LPCO device 251, preferably breaks an electrical connection to the compressor when the inlet pressure falls below a first predetermined pressure limit (for example, 6 psi). The LPCO automatically resets and establishes the electrical connection when the inlet pressure rises above a predetermined reset pressure limit (for example, 26 psi).

Figure 5A:
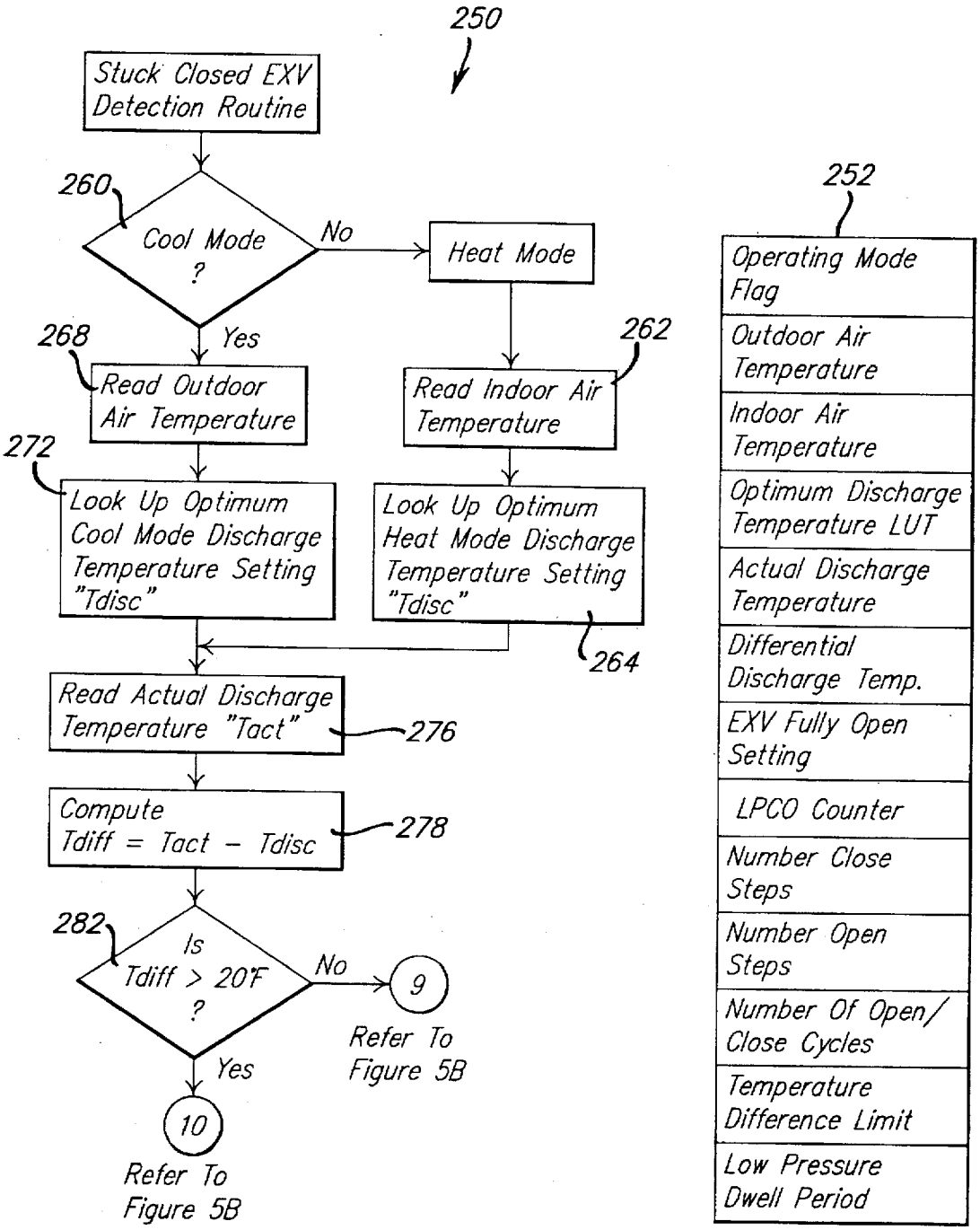
FIGS. 5A and 5B are flow charts showing the lost refrigerant charge/stuck-closed expansion valve procedure and its associated data structures.
Figure 5B:
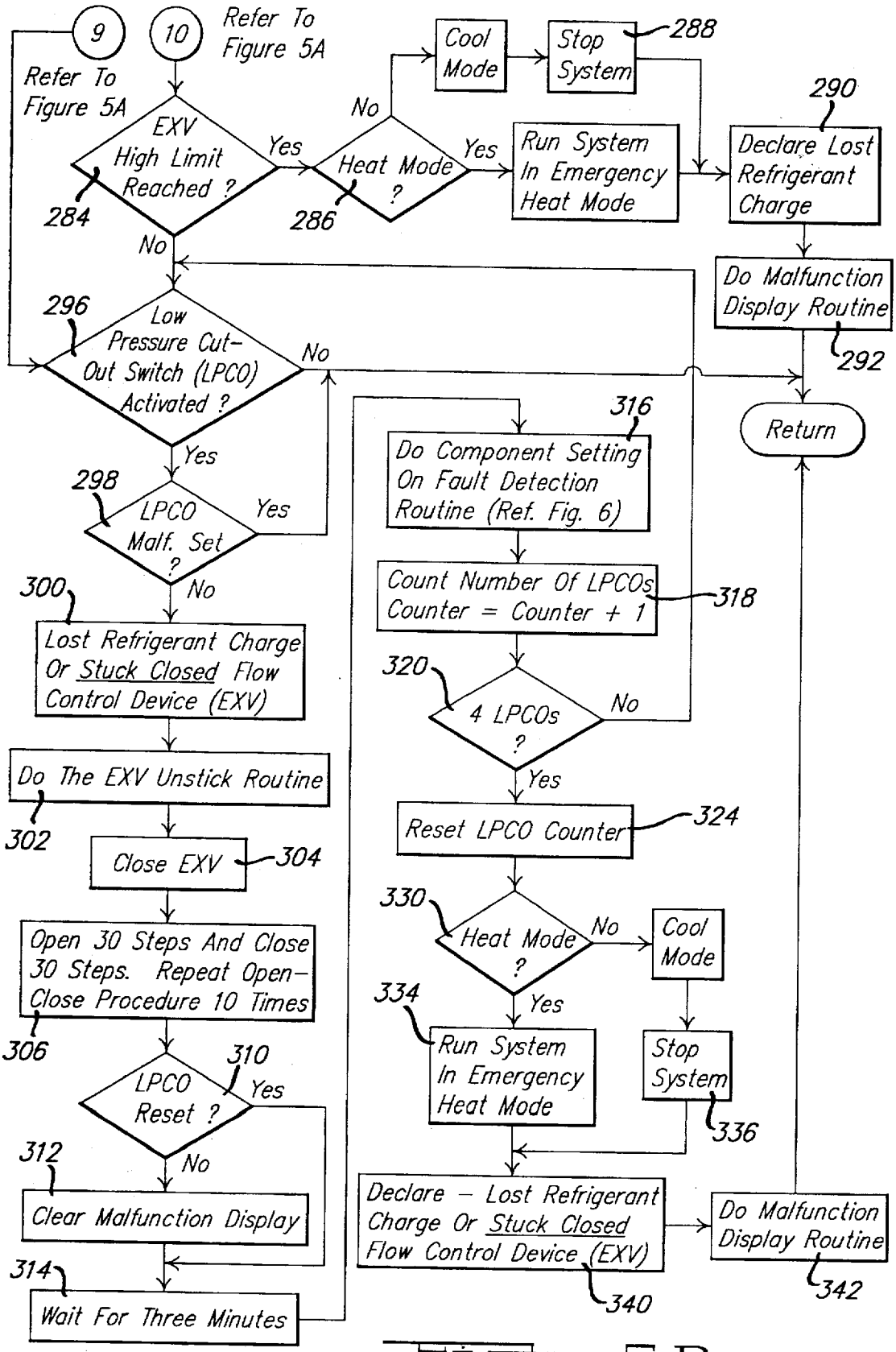
Figure 5:
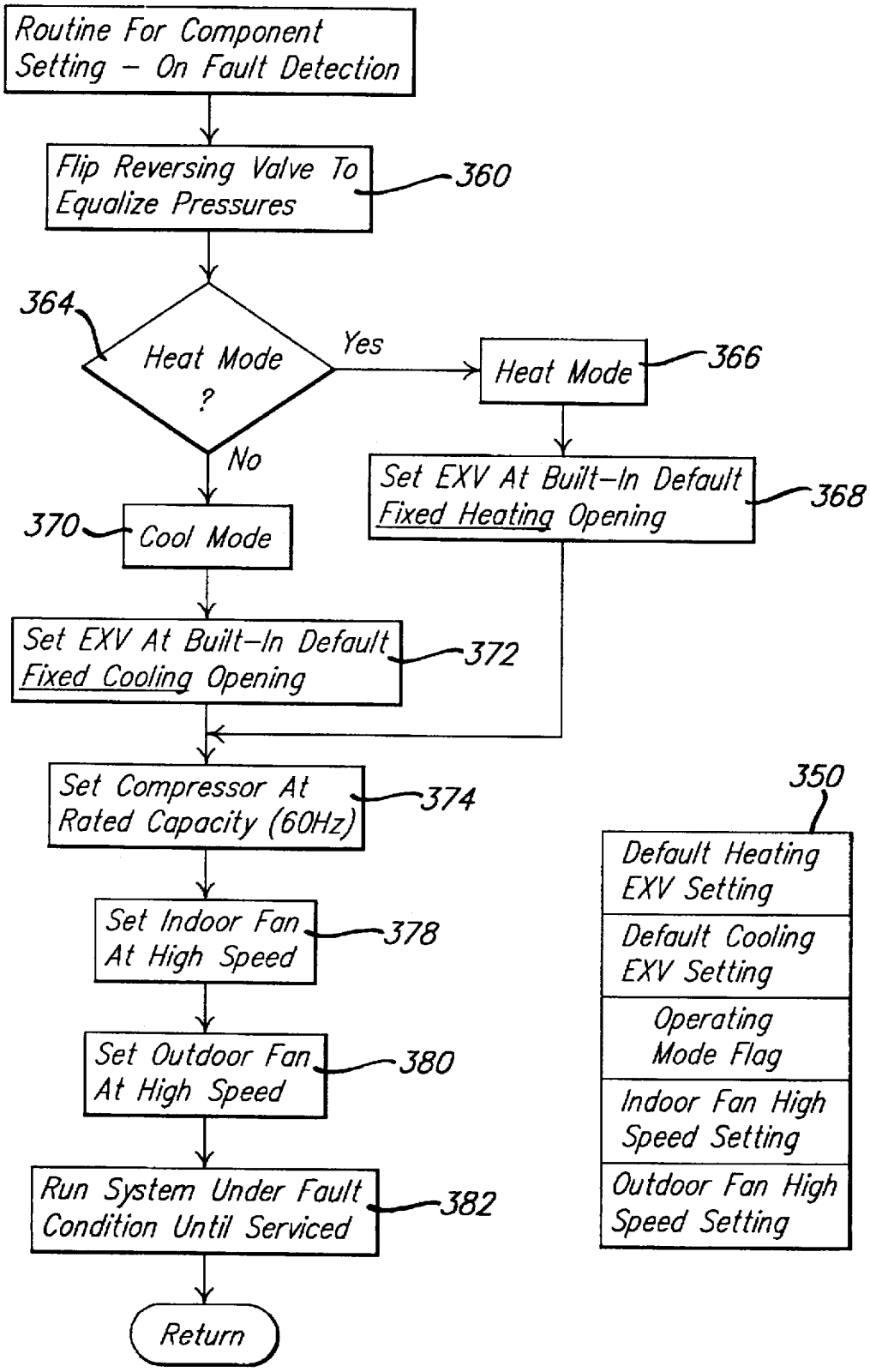

FIGS. 5A and 5B illustrate the stuck-closed expansion valve/low refrigerant charge detection procedure 250. In FIG. 5A, the data structure for the stuck-closed expansion valve/lost refrigerant charge routine is depicted diagrammatically at 252. The data structure includes an operating mode flag (indicating whether the system is in the HEATING or COOLING mode), outdoor air temperature variable (supplied by temperature sensor 56), indoor air temperature variable (supplied by temperature sensor 60), optimum temperature discharge temperature (provided as a function of the COOLING or HEATING mode and indoor and outdoor temperatures), actual discharge temperature (supplied by temperature sensor 54), differential discharge temperature (determined by taking the difference between the actual and optimum discharge temperatures), expansion valve fully opened setting (used to identify whether the expansion valve is fully open), low pressure cutout counter (used to keep a tally of short cycles during the low pressure cutout mode), and a number of close steps, open steps and open/close cycles performed during the expansion valve unstick routine.

Beginning at 260, the system checks to see if the heat pump system is operating in the COOLING mode. If not, then the indoor temperature is read using temperature sensor 60 at step 262 and the optimal heat mode discharge temperature setting is read using a lookup table, a linear function or any other suitable method in step 264.

Alternatively, if the heat pump system is in the COOLING mode as determined at step 260, the outdoor air temperature is read using outdoor temperature sensor 56 at step 268 and the optimum cool mode discharge temperature setting is read at step 272. As with the optimum heat mode discharge temperature setting, the optimum cool mode discharge temperature can be determined using a lookup table, a linear function or any other suitable method.

Control from steps 264 and 272 proceeds to step 276 where the actual discharge temperature of the compressor 38 is read employing temperature sensor 54. In step 278, the differential discharge temperature is computed by taking the difference between the actual and discharge temperatures. If the differential discharge temperature exceeds a temperature difference limit as determined at step 282, then control branches to step 284.

If the expansion valve is set to the fully open setting as determined at step 284, then the system determines if the HEATING mode is selected as determined at step 286. If not, the heat pump system is stopped at step 288 and a lost refrigerant charge malfunction is declared and displayed at steps 290 and 292. If the HEATING mode is selected at step 286, the emergency heat mode is selected and lost refrigerant charge malfunction is declared and displayed at steps 290 and 292. Afterwards, the stuck-closed expansion valve/low refrigerant charge detection procedure 250 ends.

As can be appreciated, if the differential discharge temperature exceeds the temperature limit and the expansion valve is fully open, low refrigerant charge is the likely cause.

If the differential discharge temperature is less than the temperature difference limit as determined at step 282 or the expansion valve is not in the fully-open setting as determined at step 284, control proceeds with step 296. If the low pressure cutout switch is not triggered as determined at step 284, the stuck close expansion valve/lost refrigerant charge detection procedure ends.

If the low pressure cutout switch is triggered, the system determines if the LPCL malfunction is set at step 298. If the LPCL malfunction is set, the stuck-closed expansion valve/low refrigerant charge detection procedure 250 ends. If not, control proceeds with step 300 were the system attempts to unstick the expansion valve by opening the expansion valve a predetermined number open steps (for example 10 steps), by closing the expansion valve the same number of steps and by repeating the procedure a predetermined number of times (for example ten times) as indicated by steps 300, 302, 304 and 306. Control then proceeds to step 310 where the detection procedure determines if the low pressure cutout has been reset (i.e. has the inlet pressure risen above the reset pressure limit). If not, the malfunction display is cleared at step 312 and control continues with step 314.

When the low pressure cutout is reset as determined at step 310, the system waits for a low pressure dwell period at step 314. The system then proceeds to step 316 where component settings are set to default values for fault detection routines as will be described further in conjunction with FIG. 6.

Referring to FIG. 6, the procedure for setting default values for component settings on fault detection is illustrated. A data structure for the default setting on fault detection procedure is illustrated at 350. The data structure includes a default heating expansion valve setting, a default cooling expansion valve setting, an operating mode flag, and indoor and outdoor fan high speed setting variables.

The default settings on fault detection procedure is called by step 316 of FIG. 5B. At step 360, the reversing valve 40 is reversed to equalize pressures on the inlet and discharge ends of the compressor 38. Reversing the valve 40 equalizes inlet and discharge pressure causing the inlet pressure to rise above the reset pressure limit and resetting the LPCO device 251. If the HEATING mode is selected as determined at step 364, control proceeds with step 366 and 368 which set the expansion valve opening to the default fixed heating opening setting. If not, steps 370 and 372 set the expansion valve opening to the default fixed cooling opening.

Control from steps 368 and 372 proceeds with step 374 which sets the compressor to rated capacity. The indoor and outdoor fans are set at high speed in steps 378 and 380. At step 382, the heat pump system is run under fault condition until serviced.

At step 318, the low pressure counter is incremented. At step 320, control returns to step 296 if the lower pressure cutout (LPCO) counter is equal to a predetermined number of cycles. In other words, the system "short cycles" the predetermined number of times before proceeding to step 324. To prevent heat pump damage from an excessive number of short cycles, the present invention limits the number of short cycles.

If the LPCO counter is equal to the predetermined number of cycles, control proceeds with step 324 where the LPCO counter is reset. If the system is in the HEATING mode as determined at step 330, the control runs the system in the emergency heat mode at step 334. If the heat pump system is not in the HEATING mode as determined at step 330, the heat pump system is stopped at step 336. After steps 334 and 336, control proceeds with steps 340 and 342 which declare and display the lost refrigerant charge/stuck close expansion valve malfunction.

5. Compressor Start-up Failure Detection Procedure

The present invention monitors actual compressor discharge temperature and outdoor coil temperature before startup and shortly thereafter to identify a compressor startup failure. As can be gleaned from FIGS. 8 and 9, shortly after startup is initiated, the outdoor coil temperature and compressor discharge temperature have significantly different temperatures when the compressor operates correctly.

Figure 7B:
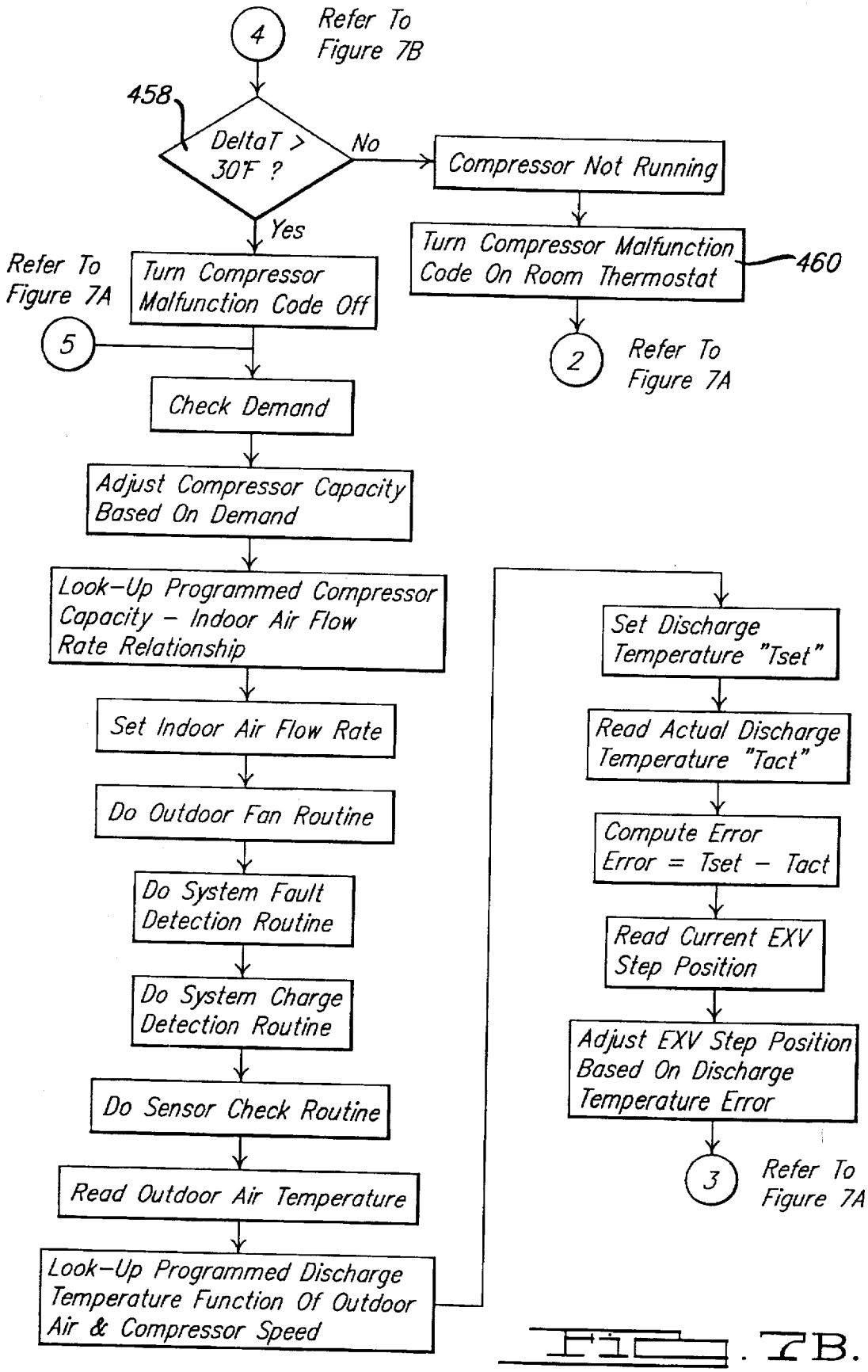

Referring to FIGS. 7A, 7B, 7C, 7D and 7E, the compressor failure detection procedure is illustrated. FIG. 7E illustrates a data structure for the compressor malfunction detection procedure. The data structure 400, in FIG. 7E, includes an operating mode flag (indicating whether the system is in the HEATING or COOLING mode), minimum compressor capacity limit and minimum outdoor fan speed limit (employed during start-up), compressor capacity/indoor air flow lookup table (indicating the desired air flow as a function of compressor capacity), expansion valve setting for the prior three cycles, average expansion valve setting (the average of the three prior cycles), indoor compressor discharge temperature before start-up, indoor/outdoor coil temperature before start-up, difference between initial discharge and coil temperatures, warm-up timer, final compressor discharge temperature, final compressor discharge temperature, final outdoor coil temperature (taken after the warm-up timer expires), final outdoor coil temperature (taken after the warm-up timer times out), difference between final discharge and coil temperature, difference between final differences and initial differences in the discharge and coil temperatures, a cooling differential limit and a heating differential limit.

The compressor malfunction detection procedure determines if the system is in the COOLING mode in FIG. 7A at step 410. If the system is in the COOLING mode, control proceeds to step 414 where control determines whether a system demand is present. If a demand present, control branches to step 418 where the system determines if the auto fan setting is on. If not, the Fan-On mode is selected at step 420.

If the heat pump system is in the start-up mode as determined at step 422, the system sets the compressor at minimum capacity in step 424 and sets the outdoor fan at minimum speed in step 426. In steps 428 and 430, the compressor capacity is used to determine a proper air flow rate relationship and the indoor air flow rate is set. In step 434, the expansion valve is set to an opening based on the average of three previous on-cycles. The sensors are checked in step 436.

In step 440, the initial compressor discharge temperature and the outdoor coil temperature are measured. The difference between the initial compressor discharge temperature and the initial coil temperature is computed. In step 442, the system is started and a fault detection routine is performed at step 444. At step 446 a timer is started and control loops at step 448 until the warm-up timer times out. The sensors are checked at step 450. At step 454, the final compressor discharge temperature and final outdoor coil temperature are read and a difference between the final compressor discharge temperature and final outdoor coil temperature is computed. At step 456, the difference between the final difference computed at step 454 and the initial difference computed at step 440 is calculated.

At step 458 the difference between the initial and final differences is compared to a cooling differential limit. If the difference is greater than the cooling differential limit, the compressor is presumed to be in an operating state and steady state operation begins. If the difference between the final difference and the initial difference is less than the cooling differential limit, the compressor is not running and the system turns on the compressor malfunction code for display on the room thermostat at step 460. Control returns to step 410 and control attempts to turn the compressor on again.

Figure 8:
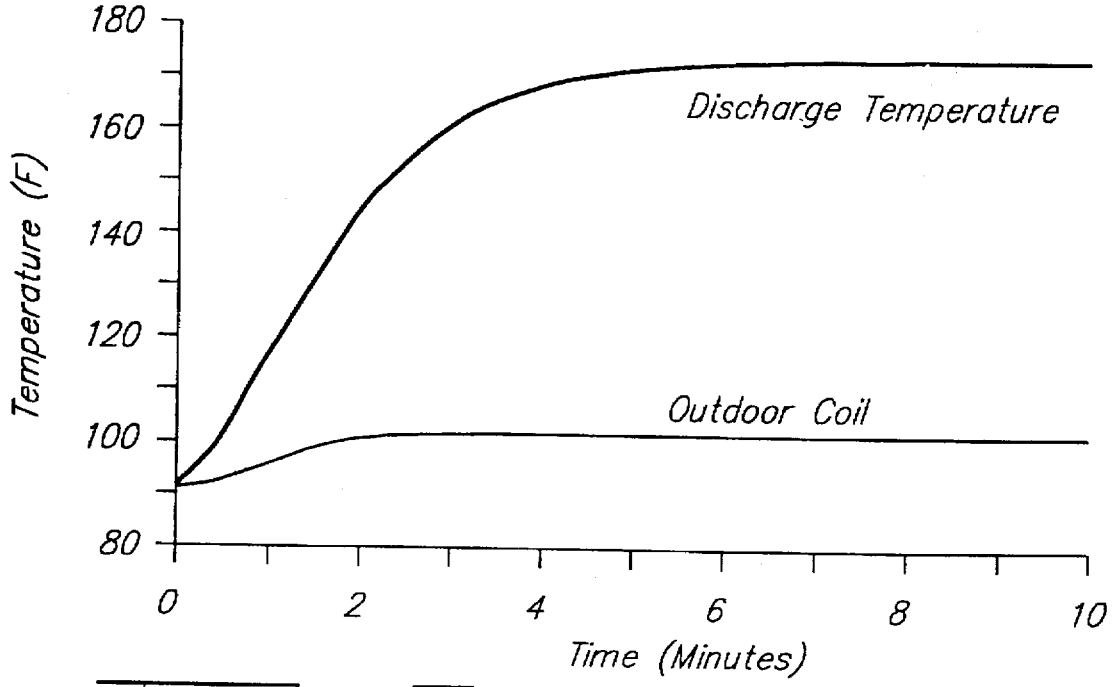
FIG. 8 is a graph showing the relationship between discharge temperature and outdoor coil temperature during start-up in the COOLING mode.

FIG. 8 illustrates the difference between compressor discharge temperature and outdoor coil temperature as a function of time after start-up of the COOLING mode. As can be appreciated from FIG. 8, before start-up discharge temperature and outdoor coil temperature are approximately equal depending upon how much time has elapsed since prior operation. Several minutes after start-up, the compressor discharge temperature and outdoor coil temperature differ in a linear relationship with time until a maximum is asymptotically reached. If the compressor has not started, such a difference would not exist. By monitoring the compressor discharge temperature and coil temperature, compressor malfunction can be identified.

Figure 7C:
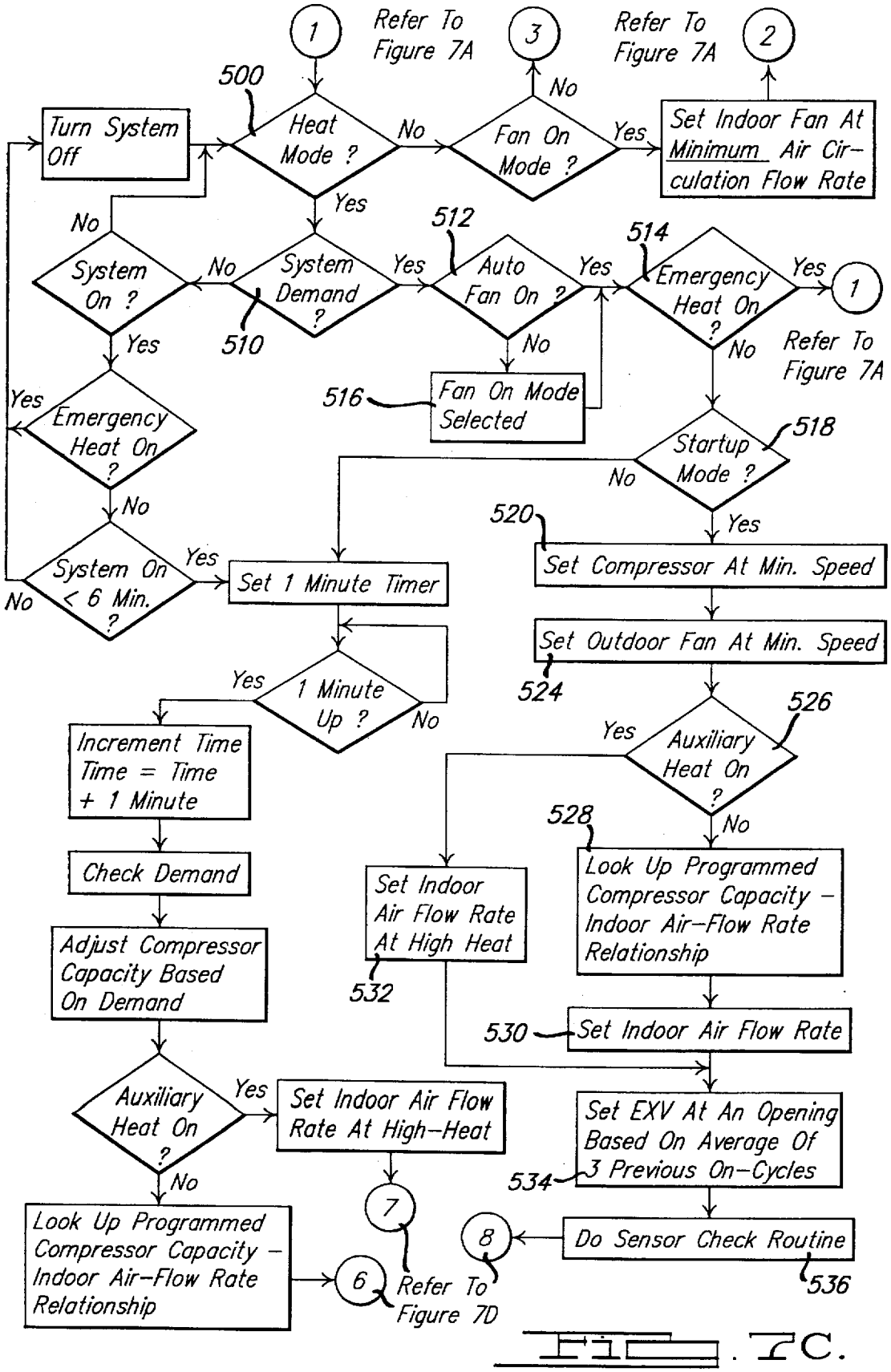

If the heat pump system is in the HEATING mode, control branches at steps 410 and 500 to step 510 in FIG. 7C. If the system is in an Auto-Fan mode as determined at step 512, control proceeds with step 514. Otherwise the fan is turned on at step 516. After steps 514 and 516, the system determines if Emergency Heat is on. If not, the system determines if the heat pump system is in the start-up mode at step 518. If the start-up mode is selected control branches to steps 520 and 524 where the compressor and outdoor fan speed are at minimum speeds.

If the auxiliary heat is not on as determined at step 526, control branches to step 528 were the indoor air flow rate is selected based upon the compressor capacity and set at steps 528 and 530. If the auxiliary heat is on, the indoor air flow rate is set based upon high heat at step 532. Control from steps 530 and 532 proceeds at step 534 were the expansion valve is set based upon the average of the three previous on cycles. At step 536, the sensors are checked.

Figure 7D:
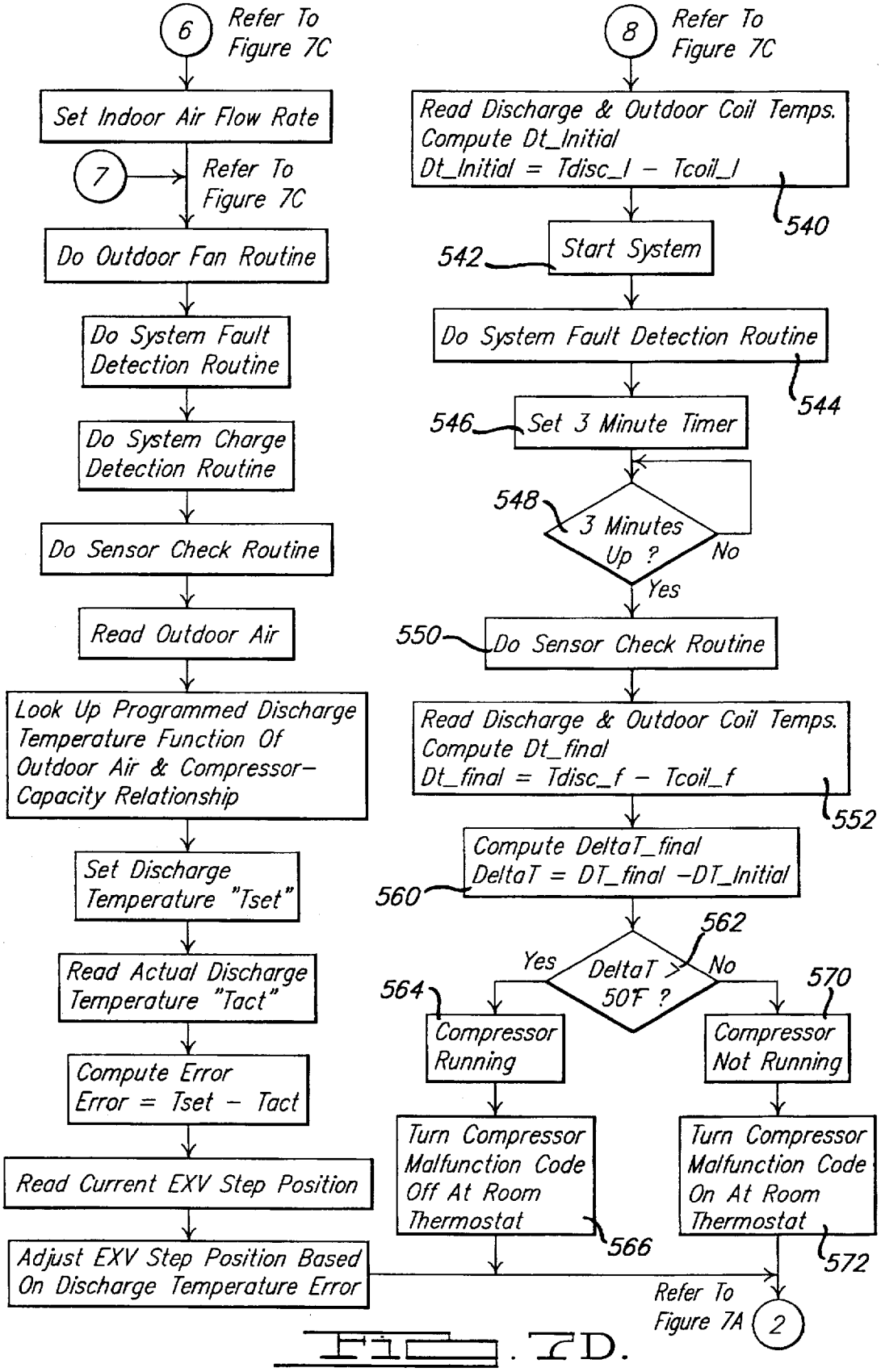

Referring for FIG. 7D, the initial compressor discharge temperature and initial outdoor coil temperature is read and a difference between the initial compressor discharge temperature and initial outdoor coil temperature are computed at step 540.

The system is started at step 542 and a fault detection routine is executed at step 544. Steps 546 and 548 initiate a warm-up timer and loop until the warm-up timer times out. At step 550 control checks the sensors. At step 552, the final compressor discharge temperature and final outdoor coil temperature are read and the difference between the final compressor discharge temperature and the final outdoor coil temperature is computed. At step 560, the difference between the final difference as computed at step 552 and the initial difference as computed at step 540 is computed. At step 562, the difference is compared to a heating differential limit. If the difference exceeds the differential heating limit, control assumes that the compressor is running and the compressor malfunction codes are turned off at steps 564 and 566. If the differential as determined at step 562 is not greater than the heating differential limit, control determines that the compressor is not running and turns on the compressor malfunction at the room thermostat at steps 570 and 572 and control proceeds at step 410.

Figure 9:
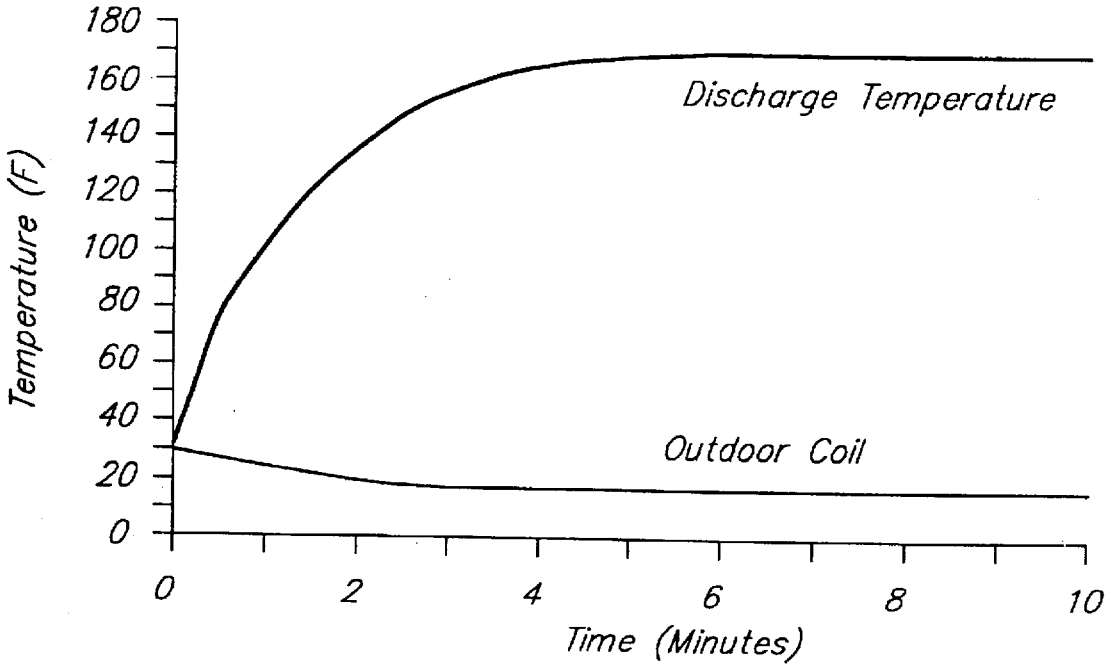
FIG. 9 is a graph showing the relationship between discharge temperature and outdoor coil temperature during the HEATING mode.

Referring to FIG. 9, the difference between the discharge temperature and the outdoor coil temperature is illustrated for a compressor which runs properly during start-up of the HEATING mode. As can be appreciated, at start-up the outdoor coil temperature and compressor discharge temperature are approximately equal. Once the compressor is started, compressor discharge temperature increases approximately linearly and asymptotically reaches a maximum while the outdoor coil temperature decreases slightly in temperature. If the compressor does not start, the compressor discharge temperature and outdoor coil temperature would remain approximately equal.

The foregoing has illustrated the present preferred embodiment of the invention in detail. Although the preferred embodiment has been illustrated, it will be understood that the illustrated configuration can be modified without departing from the spirit of the invention as set forth in the appended claims.

What is claimed is:

1. A controller for a heat pump system which operates in heating and cooling modes and is of the type having a compressor for discharging refrigerant through an expansion valve (EXV) into a heat exchanger, comprising:

a first sensor for sensing a first parameter indicative of the actual temperature of the refrigerant discharged from said compressor; and at least one control processor having means for effecting a diagnostic procedure that:

(a) determines an optimum discharge temperature;

(b) generates a differential temperature by taking the difference between the actual discharge temperature and the optimum discharge temperature; and (c) executes a low pressure diagnostic procedure if said differential temperature is less than a first parameter.

2. The controller for a heat pump system of claim 1 further comprising:

a second sensor for sensing a second parameter indicative of the ambient air temperature;

a third sensor for sensing a third parameter indicative of thermal load on the heat pump system, wherein said at least one control processor calculates said optimum discharge temperature based on said second and third parameters.

3. The control system of claim 2 wherein said third sensor comprises:

a room temperature sensor for sensing a quantity indicative of room temperature;

a means for establishing a desired temperature set point;

a demand counter for accumulating a value indicative of thermal load; and a load determining system for comparing said room temperature with said desired temperature set point and for altering the value accumulated by said demand counter based on said comparison.

4. The controller for a heat pump system of claim 1 further comprising:

a low pressure cutout (LPCO) means coupled to said compressor for disconnecting said compressor when pressure on an inlet side of said compressor falls below a fourth parameter and for reconnecting said compressor when said pressure rises above a fifth parameter, wherein when said LPCO means disconnects said compressor, said at least one control processor, coupled to said low pressure cutout means and said EXV, executes said low pressure malfunction diagnostic that:

(a) attempts to free said EXV, (b) operates said heat pump at default settings, and (c) increments a cycle counter, wherein if said cycle counter is less than a first predetermined number and said LPCO means disconnects said compressor, said at least one control processor performs (a)–(c), and if said cycle counter equals said first predetermined number, said at least one control processor declares a malfunction.

5. The controller for a heat pump system of claim 4 wherein said at least one control processor attempts to release said EXV by:

(a1) partially opening said EXV, (a2) partially closing said EXV, and (a3) repeating steps (a1) and (a2) a second predetermined number of times.

6. The controller for a heat pump system of claim 4 wherein said at least one control processor operates at default settings by:

(b1) reversing a reversing valve, (b2) setting said EXV at a first predetermined position, (b3) setting said indoor fan speed to a first predetermined speed, and (b4) setting said outdoor fan speed to a second predetermined speed.

7. The controller for a heat pump system of claim 4 wherein said at least one control processor stops said heat pump system if said cycle counter equals said predetermined number and said heat pump system is operating in said cooling mode.

8. The controller for a heat pump system of claim 2 wherein said at least one control processor initiates an emergency heating mode if said cycle counter equals said predetermined number and said heat pump system is operating in said heating mode.

9. The controller for a heat pump system of claim 4 wherein said at least one control processor declares at least one of a lost refrigerant charge malfunction and a stuck EXV malfunction.

10. The controller for a heat pump system of claim 1 wherein, if said differential temperature exceeds said first parameter, said at least one control processor executes a lost refrigerant charge diagnostic procedure that:

(a) determines if said EXV is fully open;

(b) if said EXV is fully open, stops said heat pump system and declares a lost refrigerant charge malfunction.

* * * * *

UNITED STATES PATENT AND TRADEMARK OFFICE

CERTIFICATE OF CORRECTION

PATENT NO. : 5,689,963

DATED : November 25, 1997

INVENTOR(S) : Vijay Bahel et al

It is certified that error appears in the above-indentified patent and that said Letters Patent is hereby corrected as shown below:

'n the Title Page under U.S. Patent Documents, Reference 2,978,879, "6/1961" should be -- /1961 --.

'n the Title Page under U.S. Patent Documents, Reference 3,047,696, "12/1962" should be - 7/1962 --.

:olumn 1, line 5, "1996" should be -- 1995 --.

:olumn 2, line 10, "Applicant's" should be -- Applicants' --.

:olumn 2, line 12, "Applicant's" should be -- Applicants' --.

:olumn 2, line 62, after "is" insert "a".

:olumn 7, line 42, after "a" insert "running".

:olumn 8, line 27, after "number" insert "of".

UNITED STATES PATENT AND TRADEMARK OFFICE

CERTIFICATE OF CORRECTION

PATENT NO. : 5,689,963

DATED : November 25, 1997

INVENTOR(S) : Vijay Bahel et al

It is certified that error appears in the above-indentified patent and that said Letters Patent is hereby corrected as shown below:

'olumn 9, lines 40, 41, delete "final compressor discharge temperature" (second ccurrence).

'olumn 9, line 53, after "demand" (second occurrence) insert -- is --.

Signed and Sealed this

Nineteenth Day of May, 1998

Bruce Lehman

*Attest:*

BRUCE LEHMAN

*Attesting Officer*

*Commissioner of Patents and Trademarks*